US011137118B2

(12) United States Patent
Ren et al.

(10) Patent No.: US 11,137,118 B2
(45) Date of Patent: Oct. 5, 2021

(54) LED LAMP

(71) Applicant: CONSUMER LIGHTING (U.S.), LLC, Norwalk, CT (US)

(72) Inventors: Xiaojun Ren, Shanghai (CN); Kun Xiao, Shanghai (CN); Jon Mallery, Bucyrus, OH (US); Hai Huang, Shanghai (CN); Chunxiao Gao, Shanghai (CN)

(73) Assignee: SAVANT TECHNOLOGIES LLC, East Cleveland, OH (US)

( * ) Notice: Subject to any disclaimer, the term of this patent is extended or adjusted under 35 U.S.C. 154(b) by 0 days.

(21) Appl. No.: 17/069,156

(22) Filed: Oct. 13, 2020

(65) Prior Publication Data

US 2021/0148518 A1 May 20, 2021

(30) Foreign Application Priority Data

Nov. 18, 2019 (CN) ..... 201921987944.7

(51) Int. Cl.

| | |
|---|---|
| ***F21K 9/238*** | (2016.01) |
| ***F21V 23/00*** | (2015.01) |
| ***F21V 23/06*** | (2006.01) |
| ***F21Y 115/10*** | (2016.01) |

(52) U.S. Cl.

CPC ..... *F21K 9/238* (2016.08); *F21V 23/005* (2013.01); *F21V 23/006* (2013.01); *F21V 23/06* (2013.01); *F21Y 2115/10* (2016.08)

(58) Field of Classification Search

CPC ..... F21K 9/238; F21K 9/235; F21V 23/006; F21V 23/001; F21V 23/002; F21V 19/0005

See application file for complete search history.

(56) References Cited

U.S. PATENT DOCUMENTS

| | | | | |
|---|---|---|---|---|
| 8,981,636 | B2 * | 3/2015 | Matsuda | F21K 9/90 313/318.02 |
| 10,718,470 | B1 * | 7/2020 | Wu | F21K 9/235 |
| 2008/0143231 | A1 * | 6/2008 | Johnson | H01J 5/62 313/318.01 |
| 2012/0069545 | A1 * | 3/2012 | Choi | F21V 19/0055 362/84 |
| 2013/0003361 | A1 * | 1/2013 | Igaki | H05B 47/10 362/184 |
| 2014/0103794 | A1 * | 4/2014 | Ueda | F21K 9/23 313/318.01 |

(Continued)

*Primary Examiner* — William N Harris
(74) *Attorney, Agent, or Firm* — Wood IP LLC

(57) ABSTRACT

The present application provides a LED lamp, wherein the LED lamp comprises: a lighting assembly comprises a lamp post, rigid wires are provided at the bottom of the lamp post; a driving unit comprises a PCB, a connector is provided on the PCB and is electrically connected with the PCB; and a base component is provided at the bottom of the lighting assembly, accommodates the driving unit, and electrically connected with the driving unit by connection wires extended from the driving unit, wherein, the LED lamp further comprises a bracket positioned in the base component, wire guiding holes are provided on the bracket, so that the rigid wires pass through the wire guiding holes to electrically connected with the connector. By such arrangement, automatic and high-speed assembly of the LED lamp may be achieved.

20 Claims, 3 Drawing Sheets

(56) References Cited

U.S. PATENT DOCUMENTS

| | | | | |
|---|---|---|---|---|
| 2014/0226334 | A1* | 8/2014 | Wan | F21V 29/507<br>362/249.02 |
| 2014/0286020 | A1* | 9/2014 | Tsai | F21V 17/14<br>362/363 |
| 2015/0098230 | A1* | 4/2015 | Tamura | F21V 29/70<br>362/382 |

* cited by examiner

LED LAMP

CROSS-REFERENCE TO RELATED APPLICATION

This application claims priority to and the benefit of Chinese Patent Application No. 201921987944.7, filed on Nov. 18, 2019, the entire contents of which are incorporated herein by reference.

TECHNICAL FIELD

The present application generally relates to a technical field of lamp, and in particular to a LED lamp.

BACKGROUND

A LED lamp has become a perfect alternative of a traditional incandescent lamp because of a glass appearance and a feature of 360 degrees of a beam angle thereof. Along with improvement of technologies and manufacturing processes, the LED lamp becomes brighter and cheaper, and is more and more popular in the market. Compared with the traditional incandescent lamp, the manufacturing processes of the LED lamp become more complicated because of a driver in a base structure.

In prior art, connection of a lamp filament component and a driving board generally adopts solder mud bonding and fixing, wherein assembling operation is complicated, production efficiency is lower and circuit disconnection is easily caused because solder mud is fallen off, and a lamp filament component generally cannot be detached after connected with a Printed Circuit Board (PCB), so that the PCB cannot be maintained or replaced separately. In addition, in order to continuously use a traditional high-speed halogen lamp manufacturing line, an improved LED lamp needs to be provided.

SUMMARY

In view of this, the present application provides an LED lamp to overcome the above defects.

The present application provides an LED lamp, wherein the LED lamp comprises: a lighting assembly comprises a lamp post at the bottom of which rigid wires are provided; a driving unit comprises a PCB on which a connector is provided, and is electrically connected with the PCB; and a base component is provided at the bottom of the lighting assembly, accommodates the driving unit, and electrically connected with the driving unit by connection wires extended from the driving unit, wherein, the LED lamp further comprises a bracket positioned in the base component, on which wire guiding holes are provided so that the rigid wires pass through the wire guiding holes to electrically connected with the connector.

Further, the rigid wires comprises a positive electrode wire and a negative electrode wire, and the wire guiding holes comprises a positive electrode wire guiding hole and a negative electrode wire guiding hole. Further, the positive electrode wire and the negative electrode wire have different colors. Further, an indicator is provided near one of the positive electrode wire guiding hole and the negative electrode wire guiding hole. By such arrangement, the rigid wires with the suitable diameter are matched with the wire guiding holes of the bracket, so as to accurately realize positive and negative polarity matching of them, thereby the automatic and high-speed assembly may be promoted.

Further, the wire guiding holes are funnel-shaped, so that the rigid wires are guided to pass through the wire guiding holes. By such arrangement, the funnel-shaped structure is benefit to guide the rigid wires into the wire guiding holes in the bracket, thereby the high-speed assembly may be promoted.

Further, the LED lamp further comprises an insulating sleeve which is installed in the base component, the driving unit is provided in the insulating sleeve, and a gap is defined between the driving unit and the insulating sleeve.

Further, the bracket comprises a horizontal body portion and two legs vertically extended from two ends of the body portion, further, the legs are snapped and fixed in the gap.

Further, the legs have a first end connected with the body portion and a second end opposite to the first end, a hook portion stretched inward is provided at the second end so that while the legs are snapped and fixed in the gap, the hook portion is connected to a bottom surface of the PCB departing from the lighting assembly.

Further, the driving unit, the base component, the bracket and the insulating sleeve are assembled together to form an integrated base assembly. By such arrangement, the integrated base assembly is matched with the lighting assembly, thereby the high-speed assembly may be promoted.

The present application also provides a LED lamp, wherein the LED lamp comprises: a lighting assembly, at the bottom of which rigid wires are provided; and an integrated base assembly is connected to the bottom of the lighting assembly and accommodates the rigid wires; wherein the integrated base assembly comprises a bracket on which wire guiding holes are provided so that the rigid wires pass through the wire guiding holes to electrically connected with a driving unit inside the integrated base assembly.

Further, the integrated base assembly further comprises a base component which accommodates the rigid wires, the driving unit and the bracket, and electrically connected with the driving unit by connection wires extended from the driving unit. Further, the wire guiding holes are funnel-shaped, so that the rigid wires are guided to pass through the wire guiding holes. Further, the integrated base assembly further comprises an insulating sleeve which is provided inside the base component, the driving unit is provided inside the insulating sleeve, and a gap is defined between the driving unit and the insulating sleeve. Further, the bracket comprises a horizontal body portion and two legs vertically extended from two ends of the body portion, the legs are snapped and fixed in the gap.

The present application also provides A method for producing a LED lamp, wherein the method comprises: preparing a lighting assembly, wherein rigid wires are provided at the bottom of the lighting assembly; pre-assembling a driving unit, a base component, a bracket and an insulating sleeve into an integrated base assembly, wherein wire guiding holes are provided on the bracket; and passing the rigid wires through the wire guiding holes to electrically connected with the driving unit, so that the lighting assembly and the integrated base assembly are assembled together.

Further, the base component accommodates the rigid wires, the driving unit, the bracket and the insulating sleeve, and electrically connected with the driving unit by connection wires extended from the driving unit. Further, the wire guiding holes are funnel- shaped, so that the rigid wires are guided to pass through the wire guiding holes. Further, the insulating sleeve is provided inside the base component, the driving unit is provided inside the insulating sleeve, and a gap is defined between the driving unit and the insulating sleeve. Further, the bracket comprises a horizontal body portion and two legs vertically extended from two ends of the body portion, the legs are snapped and fixed in the gap.

DETAILED DESCRIPTION OF THE EMBODIMENTS

Technical solutions in the embodiment of the present application are described in detail in combination with the drawings in the embodiment of the present application below. It is noted that the embodiments in the present application and features in the embodiment may be mutually combined without conflicting.

Figure 1:
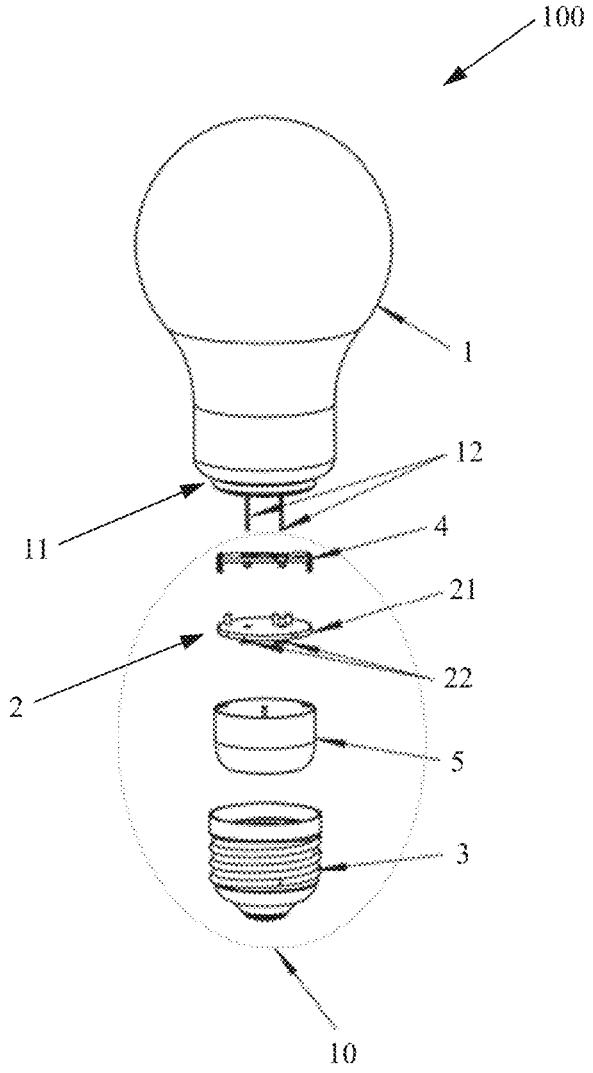
FIG. 1 is an exploded perspective view of an LED lamp according to an embodiment of the present application.
Figure 2:
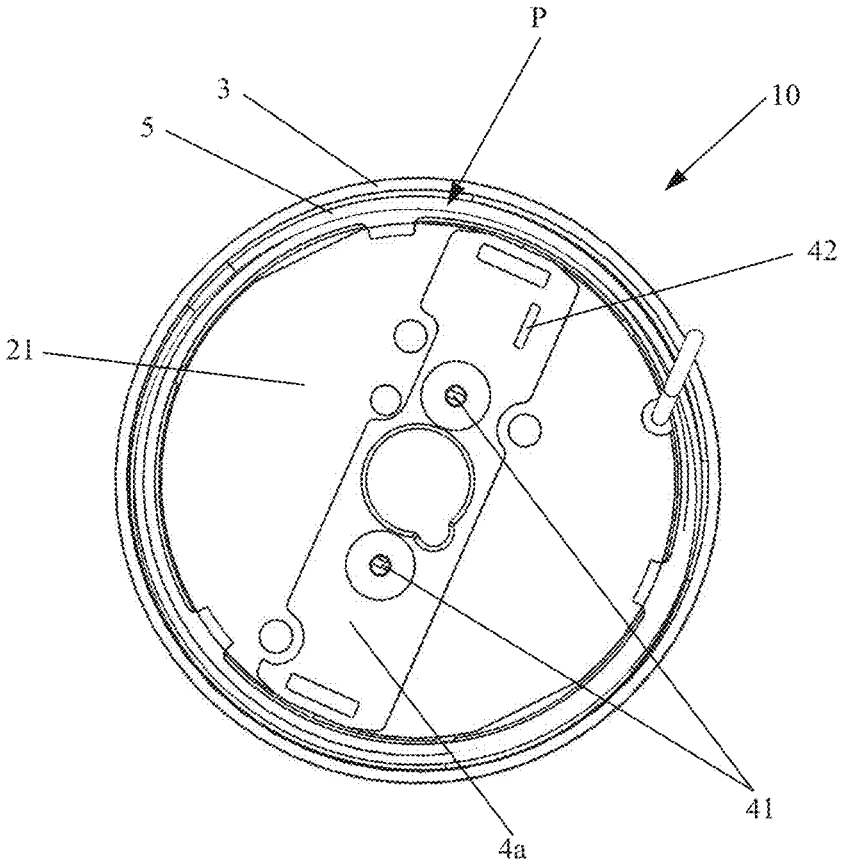
FIG. 2 is a top view of an integrated base assembly of the LED lamp according to the embodiment of the present application.

As shown in FIG. 1 and FIG. 2, the LED lamp 100 according to the embodiment of the present application generally comprises a lighting assembly 1, a driving unit 2 and a base component 3. The lighting assembly 1 comprises a lamp post 11 at the bottom of which a rigid wire 12 is provided. The driving unit 2 comprises a PCB 21 on which a connector 22 is provided, and is electrically connected with the PCB 21. The base component 3 is provided at the bottom of the lighting assembly 1. The base component 3 accommodates the driving unit 2 and is electrically connected with the driving unit 2 by connection wires extended from the driving unit 2.

The LED lamp 100 further comprises a bracket 4 positioned in the base component 3. Wire guiding holes 41 are provided on the bracket 4 so that the rigid wires 12 pass through the wire guiding holes 41 to electrically connected with the connector 22. Specifically, the bracket 4 is generally positioned between the lighting assembly 1 and the driving unit 2.

The rigid wires 12 comprises a positive electrode wire and a negative electrode wire, and they are not shown distinguishingly in the drawings, in other words, the left one of the two rigid wires 12 as shown in FIG. 1 may be the positive electrode wire, and the right one may be the negative electrode wire, or the left one of the two rigid wires 12 may be the negative electrode wire, and the right one may be the positive electrode wire. In addition, the wire guiding holes 41 in the bracket 4 comprise a positive electrode wire guiding hole and a negative electrode wire guiding hole, the positive electrode wire guiding hole and the negative electrode wire guiding hole are correspondingly matched with the positive electrode wire and the negative electrode wire. In addition, the positive electrode wire and the negative electrode wire may have different colors, so that positions of the positive electrode wire and the negative electrode wire are accurately and conveniently acknowledged, and an indicator 42 is provided near one of the positive electrode wire guiding hole and the negative electrode wire guiding hole, so as to clearly show that the wire guiding hole adjacent to the indicator 42 is the positive electrode wire guiding hole or the negative electrode wire guiding hole. Thus, by such arrangement, the rigid wire 12 with the suitable diameter is matched with the wire guiding holes 41 of the bracket, so as to accurately realize positive and negative polarity matching of them, thereby the automatic and high-speed assembly may be promoted.

Figure 3A:
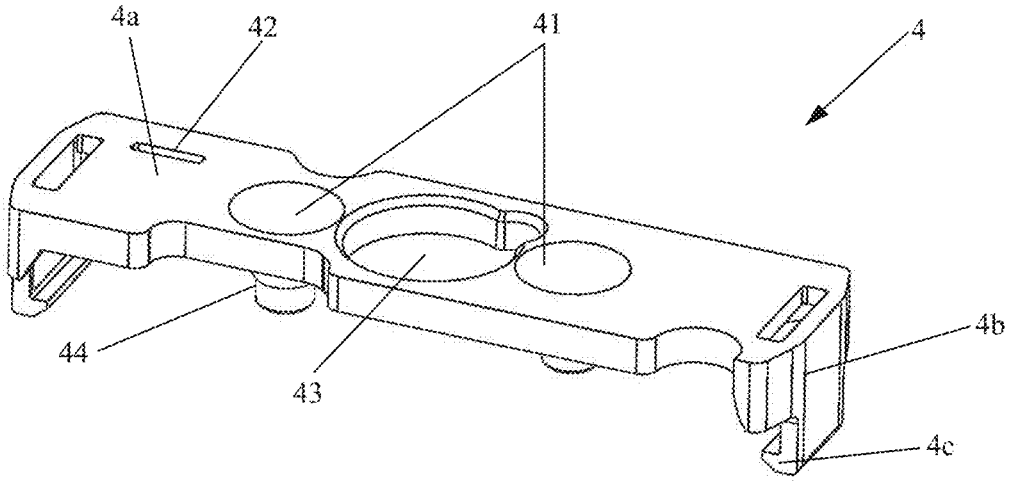
FIG. 3*a* is a perspective view of a bracket of the LED lamp according to the embodiment of the present application.
Figure 3B:
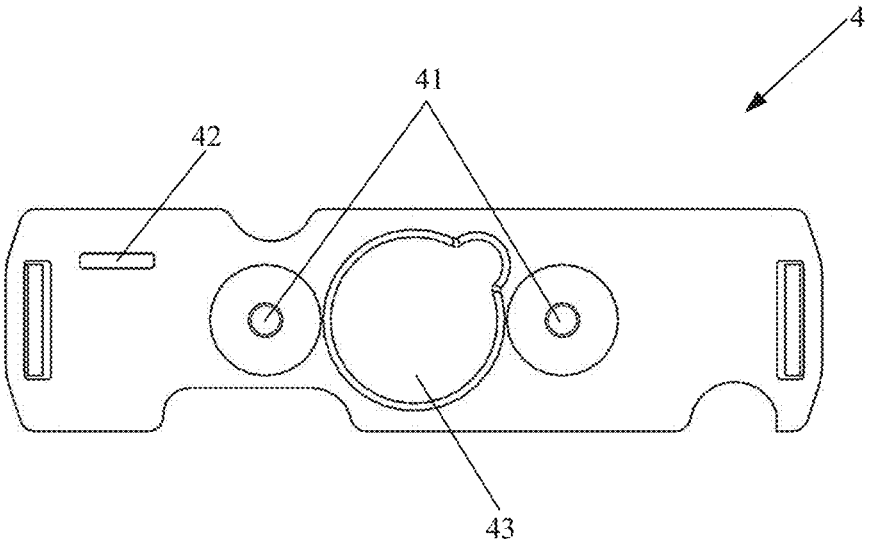
FIG. 3*b* is a top view of the bracket of the LED lamp according to the embodiment of the present application.

As shown in FIG. 3*a* and FIG. 3*b*, the wire guiding holes 41 are funnel-shaped, to guide the rigid wire 12 to pass through the wire guiding holes 41. Specifically, the bracket 4 may comprise a horizontal body portion 4*a* and two legs 4*b* vertically extended from two ends of the body portion 4*a*. The funnel-shaped wire guiding holes 41 penetrate the body portion 4*a* of the bracket 4 in a vertical direction, and has a variable diameter in the vertical direction, namely, the diameter of the wire guiding holes 41 is tapered from a top surface of the body portion 4*a* facing the lighting assembly 1 to a bottom surface of the body portion 4*a* facing the driving unit 2. Therefore, while the rigid wires 12 pass through the wire guiding holes 41, the rigid wires 12 firstly pass through a part of the wire guiding holes 41 with a larger diameter, and then are guided by such funnel-shaped structure, to conveniently pass through the wire guiding holes 41 via a part of the wire guiding holes with a smaller diameter, and thus such funnel-shaped structure is capable of providing a larger assembly allowance for assembling. In addition, in order to increase a depth of the wire guiding holes 41, a corresponding protruded portion 44 may be integrally protruded from a position at the bottom of the body portion 4*a* corresponding to the wire guiding hole, so that a part of the funnel- shaped wire guiding holes 41 with the tapered diameter is formed in the protruded portion 44.

In addition, as shown in FIG. 3*a* and FIG. 3*b*, a central through hole 43 may be provided at the body portion 4*a* of the bracket 4. Existence of the central through hole 43 is capable of providing an accommodating space for a part positioned at the bottom of the lighting assembly 1, so as to guarantee that the lighting assembly 1 is not interference with the bracket 4, but the present application is not limited to this, other perforations may be further provided at other positions on the bracket 4 so as to reinforce such an effect.

Turning to FIG. 1 and FIG. 2, the LED lamp 100 may further comprise an insulating sleeve 5 which is provided inside the base component 3, the driving unit 2 is provided inside the insulating sleeve 5, and a gap P is defined between the driving unit 2 and the insulating sleeve 5, specifically, as shown in FIG. 2, the insulating sleeve 5 may have a substantially circular cross section, the PCB 21 may also be substantially circular, and a diameter of the PCB 21 is slightly less than a diameter of the insulating sleeve 5, therefore, while the driving unit 2 is installed in the insulating sleeve 5, the gap P exists between the driving unit 2 and the insulating sleeve 5, and the gap P may be an annular gap, but the present application is not limited to this. The legs 4*b* of the bracket 4 may be snapped and fixed in the gap P, for example, fixed in the gap P by interference fit in a certain degree. The legs 4*b* of the bracket 4 have a first end connected with the body portion 4*a* and a second end opposite to the first end, a hook portion 4*c* stretched inward may be provided at the second end, so that while the legs 4*b* are snapped and fixed in the gap P, the hook portion 4*c* is connected to a bottom surface, of the PCB 21 departing from the lighting assembly 1, thereby the fixing of the bracket 4 and the driving unit 2 is further guaranteed.

Specifically, as shown in FIG. 2, the driving unit 2, the base component 3, the bracket 4 and the insulating sleeve 5 may be pre-assembled together to form an integrated base assembly 10. In a manufacturing line of the LED lamp 100, the high-speed assembly may be achieved by such integrated base assembly 10 and the independently formed lighting assembly 1.

The above are only optimal embodiments of the present application, and are not intended to limit the present application. Various changes and variations may be made to the present application by those skilled in the art. Within spirits and principles of the present application, any made modifications, equivalent replacements, improvements and the like shall fall within a scope of protection of the present application.

What is claimed is:

1. A LED lamp, wherein the LED lamp comprises:

a lighting assembly comprising a lamp post at a bottom of which rigid wires are provided;

a driving unit comprising a PCB on which a connector is provided, and is electrically connected with the PCB;

a base component provided at a bottom of the lighting assembly, accommodates the driving unit, and electrically connected with the driving unit by connection wires extended from the driving unit;

an insulating sleeve provided inside the base component, the driving unit provided inside the insulating sleeve, and a gap defined between the driving unit and the insulating sleeve; and a bracket positioned in the base component, on which wire guiding holes are provided so that the rigid wires pass through the wire guiding holes to be electrically connected with the connector, wherein the bracket comprises a horizontal body portion and two legs vertically extended from two ends of the body portion, and the legs are snapped and fixed in the gap defined between the driving unit and the insulating sleeve.

2. The LED lamp as claimed in claim 1, wherein the rigid wires comprise a positive electrode wire and a negative electrode wire, and the wire guiding holes comprise a positive electrode wire guiding hole and a negative electrode wire guiding hole to accommodate the positive electrode wire and the negative electrode wire respectively.

3. The LED lamp as claimed in claim 2, wherein the positive electrode wire and the negative electrode wire have different colors.

4. The LED lamp as claimed in claim 2, wherein an indicator is provided near one of the positive electrode wire guiding hole and the negative electrode wire guiding hole.

5. The LED lamp as claimed in claim 1, wherein the wire guiding holes are funnel-shaped, so that the rigid wires are guided to pass through the wire guiding holes.

6. The LED lamp as claimed in claim 1, wherein the legs have a first end connected with the body portion and a second end opposite to the first end, a hook portion stretched inward is provided at the second end so that while the legs are snapped and fixed in the gap, the hook portion is connected to a bottom surface of the PCB departing from the lighting assembly.

7. The LED lamp as claimed in claim 1, wherein the driving unit, the base component, the bracket and the insulating sleeve are assembled together to form an integrated base assembly.

8. A LED lamp, wherein the LED lamp comprises:

a lighting assembly, at a bottom of which rigid wires are provided; and an integrated base assembly connected to a bottom of the lighting assembly and accommodates the rigid wires;

a driving unit and an insulating sleeve inside the integrated base assembly, with the driving unit provided inside the insulating sleeve, and a gap defined between the driving unit and the insulating sleeve, wherein the integrated base assembly comprises a bracket on which wire guiding holes are provided so that the rigid wires pass through the wire guiding holes to be electrically connected with the driving unit, and wherein the bracket comprises a horizontal body portion and two legs vertically extended from two ends of the body portion, and the legs are snapped and fixed in the gap defined between the driving unit and the insulating sleeve.

9. The LED lamp as claimed in claim 8, wherein the integrated base assembly further comprises a base component which accommodates the rigid wires, the driving unit and the bracket, and is electrically connected with the driving unit by connection wires extended from the driving unit.

10. The LED lamp as claimed in claim 8, wherein the wire guiding holes are funnel-shaped, so that the rigid wires are guided to pass through the wire guiding holes.

11. A method for producing a LED lamp, the LED lamp comprising a lighting assembly, a driving unit, a base component, a bracket and an insulating sleeve, wherein the insulating sleeve is provided inside the base component, the driving unit is provided inside the insulating sleeve, a gap is defined between the driving unit and the insulating sleeve, wire guiding holes are provided on the bracket, and the bracket comprises a horizontal body portion and two legs vertically extended from two ends of the body portion, the method comprising:

preparing the lighting assembly to have rigid wires provided at a bottom of the lighting assembly;

pre-assembling the driving unit, the base component, the bracket and the insulating sleeve into an integrated base assembly by snapping and fixing the two legs of the bracket into the gap defined between the driving unit and the insulating sleeve; and passing the rigid wires through the wire guiding holes to be electrically connected with the driving unit, so that the lighting assembly and the integrated base assembly are assembled together.

12. The method as claimed in claim 11, wherein the base component accommodates the rigid wires, the driving unit, the bracket and the insulating sleeve, and is electrically connected with the driving unit by connection wires extended from the driving unit.

13. The method as claimed in claim 11, wherein the wire guiding holes are funnel-shaped, so that the rigid wires are guided to pass through the wire guiding holes.

14. The LED lamp as claimed in claim 8, wherein the rigid wires comprise a positive electrode wire and a negative electrode wire, and the wire guiding holes comprise a positive electrode wire guiding hole and a negative electrode wire guiding hole to accommodate the positive electrode wire and the negative electrode wire respectively and wherein an optional indicator is provided near one of the positive electrode wire guiding hole and the negative electrode wire guiding hole.

15. The LED lamp as claimed in claim 8, wherein the driving unit further comprising a PCB.

16. The LED lamp as claimed in claim 15, wherein the legs have a first end connected with the body portion and a second end opposite to the first end, a hook portion stretched inward is provided at the second end so that while the legs are snapped and fixed in the gap, the hook portion is connected to a bottom surface of the PCB departing from the lighting assembly.

17. The method as claimed in claim 11, wherein the rigid wires comprise a positive electrode wire and a negative electrode wire, and the wire guiding holes comprise a positive electrode wire guiding hole and a negative electrode wire guiding hole to accommodate the positive electrode wire and the negative electrode wire respectively and wherein an optional indicator is provided near one of the positive electrode wire guiding hole and the negative electrode wire guiding hole.

18. The method as claimed in claim 17, wherein an indicator is provided near one of the positive electrode wire guiding hole and the negative electrode wire guiding hole.

19. The method as claimed in claim 11, wherein the driving unit further comprising a PCB.

20. The method as claimed in claim 19, wherein the LED lamp further comprising a hook portion stretched inward provided at the second end and the method further comprising connecting the hook portion to a bottom surface of the PCB departing from the lighting assembly while the legs are snapped and fixed in the gap.

* * * * *